US007513594B2

(12) United States Patent
Park

(10) Patent No.: US 7,513,594 B2
(45) Date of Patent: Apr. 7, 2009

(54) SPITTING METHOD OF AN ARRAY-TYPE INKJET IMAGE FORMING APPARATUS

(75) Inventor: Jin-ho Park, Yongin-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 228 days.

(21) Appl. No.: 11/532,609

(22) Filed: Sep. 18, 2006

(65) Prior Publication Data

US 2007/0070117 A1 Mar. 29, 2007

(30) Foreign Application Priority Data

Sep. 23, 2005 (KR) ..... 10-2005-0088685

(51) Int. Cl.
*B41J 2/165* (2006.01)

(52) U.S. Cl. ..... 347/35; 347/30

(58) Field of Classification Search ..... 347/30, 347/35, 12, 15, 36

See application file for complete search history.

(56) References Cited

U.S. PATENT DOCUMENTS

| | | | |
|---|---|---|---|
| 5,805,182 | A | 9/1998 | Lee |
| 6,505,911 | B1 | 1/2003 | Hwang |

FOREIGN PATENT DOCUMENTS

| | | |
|---|---|---|
| EP | 1516734 | 3/2005 |
| JP | 6-126982 | 5/1994 |
| JP | 6-171078 | 6/1994 |
| KR | 97-33854 | 7/1997 |
| KR | 10-218558 | 11/1997 |

OTHER PUBLICATIONS

European Search Report dated Jan. 25, 2007 issued in EP 6119584.8.
Korean Office Action dated Oct. 23, 2006 issued in KR 2005-88685.

*Primary Examiner*—Lamson D Nguyen
(74) *Attorney, Agent, or Firm*—Stanzione & Kim, LLP

(57) ABSTRACT

A spitting method of an array-type inkjet image forming apparatus which prints one or more papers and then ejects ink several times to keep nozzles in the optimal condition for printing, in which the number of spitting dots is in proportion to the number of resting dots of each of the nozzles during the printing process.

22 Claims, 7 Drawing Sheets

SPITTING METHOD OF AN ARRAY-TYPE INKJET IMAGE FORMING APPARATUS

CROSS-REFERENCE TO RELATED APPLICATIONS

This application claims the benefit of Korean Patent Application No. 10-2005-0088685, filed on Sep. 23, 2005, in the Korean Intellectual Property Office, the disclosure of which is incorporated herein in its entirety by reference.

BACKGROUND OF THE INVENTION

1. Field of the Invention

The present general inventive concept relates to a spitting method to maintain a printhead in an array-type inkjet image forming apparatus.

2. Description of the Related Art

An inkjet image forming apparatus forms an image by ejecting ink from a shuttle-type inkjet printhead reciprocating in a main scanning direction perpendicular to a transfer direction (sub-scanning direction) of paper. The inkjet printhead includes a nozzle unit having a plurality of nozzles which eject ink. Recently, attempts have been made to realize high speed printing by using, instead of a shuttle-type inkjet printhead, an inkjet printhead having a nozzle unit having a length corresponding to the width of the paper in the main scanning direction. In an array-type inkjet image forming apparatus, since an inkjet printhead is fixed and only the paper is being transferred, simple and high speed printing can be performed.

An array-type inkjet printhead includes a great number of nozzles. For example, to print an image on A4 size paper, with a resolution of 600 dpi (dot/inch) in a main scanning direction, about 4960 nozzles are required. In general, an inkjet image forming apparatus of an array-type performs a spitting operation to keep the nozzles in an optimal printing condition by ejecting ink through the nozzles before or after printing. However, since an array-type image forming apparatus includes a much greater number of nozzles than a shuttle-type image forming apparatus, a large amount of ink is consumed due to spitting of nozzles in the array-type image forming apparatus.

SUMMARY OF THE INVENTION

The present general inventive concept provides a spitting method of an array-type inkjet image forming apparatus, by which the amount of ink consumed during spitting can be minimized.

Additional aspects and advantages of the present general inventive concept will be set forth in part in the description which follows and, in part, will be obvious from the description, or may be learned by practice of the general inventive concept.

The forgoing and/or other aspects and utilities of the present general inventive concept are achieved by providing a spitting method of an array-type inkjet image forming apparatus which prints one or more papers and then ejects ink several times to keep nozzles in an optimal condition for printing, wherein the number of spitting dots of the nozzles is in proportion to the number of resting dots in each of the nozzles during the printing.

The number of spitting dots NSi may be equal to NR×(NEi/NT), where i is an index of the nozzles, NT may be the total number of dots in the sub-scanning direction of a printing image, NEi may be the number of resting dots of each of the nozzles, and NR may be the number of standard spitting dots.

The number of NSi may be set as the minimum number of spitting dots when the number of spitting dots NSi calculated by the equation NSi=NR×(NEi/NT) is smaller than the minimum number of spitting dots.

The minimum number of spitting dots may be greater than five.

The forgoing and/or other aspects and utilities of the present general inventive concept are also achieved by providing a spitting method of an array-type inkjet image forming apparatus which prints one or more papers and then ejects ink several times to keep nozzles in an optimal condition for printing, the method including mapping an inverse image of a printing image with respect to the nozzles, forming a spitting image by compressing the mapped inverse image in a sub-scanning direction, and ejecting ink through the nozzles according to the spitting image.

The forgoing and/or other aspects and utilities of the present general inventive concept are also achieved by providing a spitting method of an array-type inkjet image forming apparatus which prints one or more papers and then ejects ink several times to keep nozzles in an optimal condition for printing, the method including forming a spitting image by compressing a mapped printing image with respect to the nozzles in a sub-scanning direction and then reversing the mapped printing image, and ejecting ink through the nozzles according to the spitting image.

A compression rate in the sub-scanning direction may be the same for each of the nozzles.

The compression rate in the sub-scanning direction may be obtained by dividing a number of standard spitting dots by the total number of dots in the sub-scanning direction of a printing image.

The spitting method may further include correcting the spitting image such that the number of spitting dots of each of the nozzles is equal to or greater than the minimum number of spitting dots before the spitting. In the correcting of the spitting image, only spitting images corresponding to the nozzles, of which the number of spitting dots is smaller than the minimum number of spitting dots may be corrected to have the minimum number of spitting dots. In the correcting of the spitting image, the minimum number of spitting dots may be added to the spitting image of all the nozzles.

The forgoing and/or other aspects and utilities of the present general inventive concept are also achieved by providing a spitting method of an array-type inkjet image forming apparatus which prints one or more papers and then ejects ink several times to keep nozzles in an optimal condition for printing, the method including calculating a number of spitting dots of the nozzles based on a number of resting dots in each of the nozzles during the printing process.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
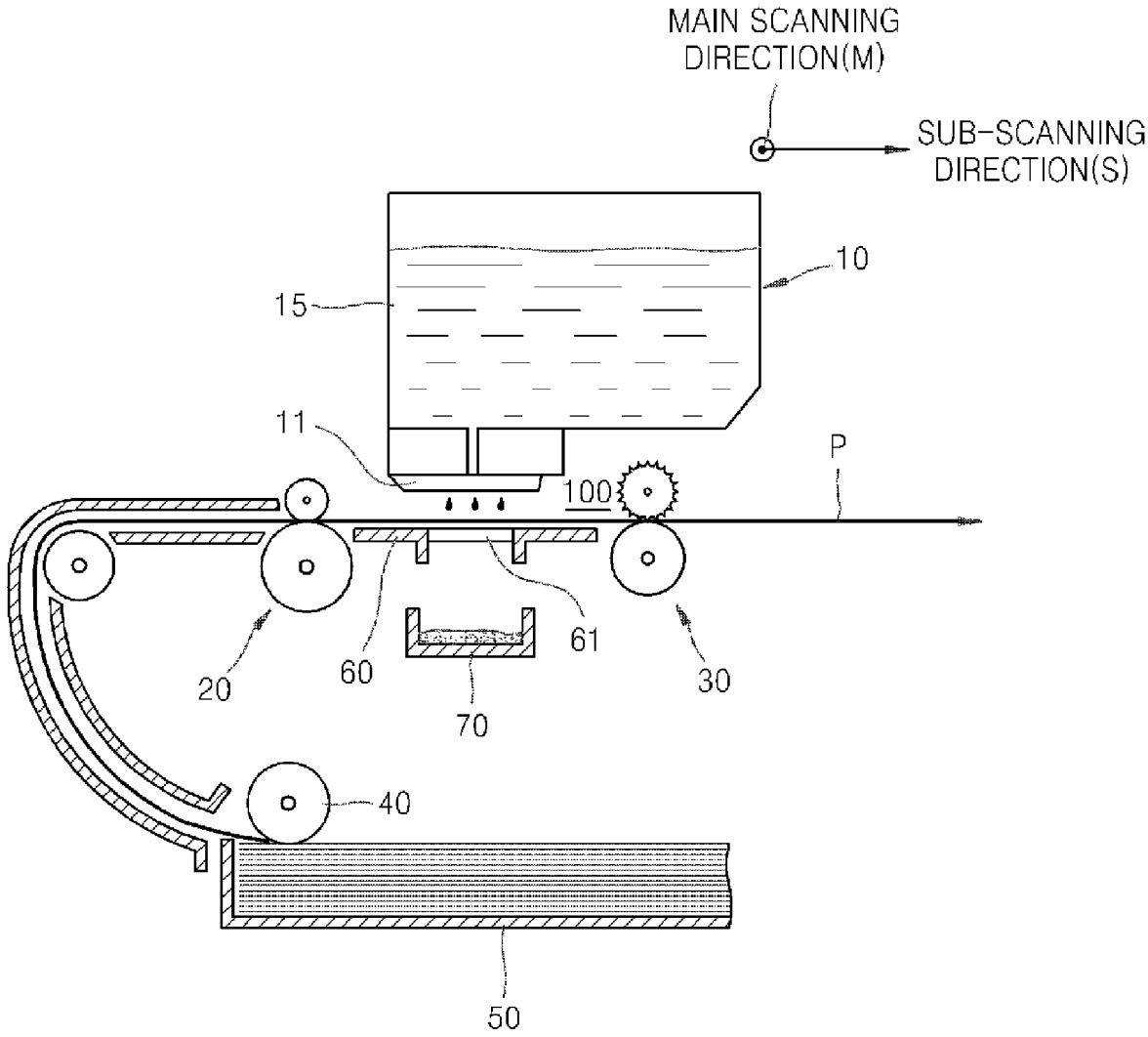
FIG. 1 is a schematic view of an inkjet image forming apparatus using a spitting method according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a schematic view of an inkjet image forming apparatus using a spitting method according to an embodiment of the present general inventive concept. Referring to FIG. 1, a paper P (or other recording medium) that gets picked up from a paper feeding cassette 50 by a pickup roller 40 is then transferred by a transfer unit 20 in a sub-scanning direction S. During the transfer operation, the paper P passes under an inkjet printhead 10. The inkjet printhead 10 prints an image on the paper P by jetting ink onto the paper P, and then the printed paper P is discharged by a discharge unit 30.

Figure 2:
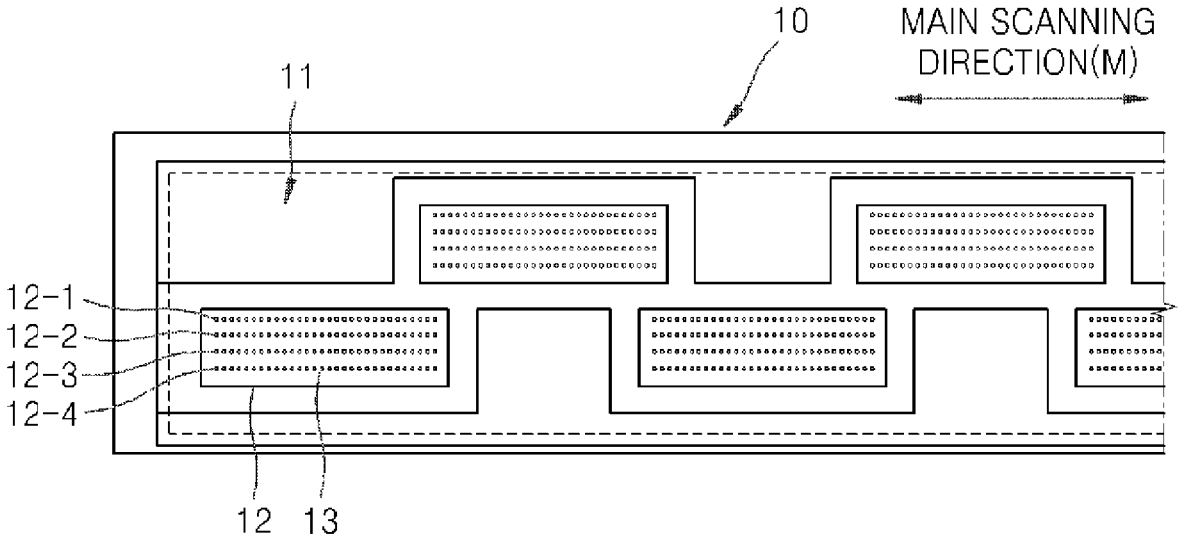
FIG. 2 illustrates a nozzle unit according to an embodiment of the present general inventive concept.

The inkjet printhead 10 in the current embodiment is an array-type inkjet printhead including a nozzle unit 11 having a length in the main scanning direction M (perpendicular to the page on which FIG. 1 is illustrated), which corresponds to the width of the paper P. FIG. 2 illustrates an exemplary embodiment of the nozzle unit 11. Referring to FIG. 2, the nozzle unit 11 can include a plurality of nozzle plates 12 arranged in a zigzag formation in the main scanning direction M. A plurality of nozzles 13 are formed on each of the nozzle plates 12. The nozzle plates 12 may have a plurality of nozzle rows such as 12-1, 12-2, 12-3, and 12-4. Each of the nozzle rows 12-1, 12-2, 12-3, and 12-4 may eject one color ink or different colors of ink such as cyan, magenta, yellow, and black. The nozzle unit 11 of FIG. 2 is an exemplary embodiment that does not restrict the scope of the present general inventive concept. Although not illustrated in the drawing, the inkjet printhead 10 includes a chamber including an ejecting unit (e.g., a piezoelectric device or a heater) connected in line with the nozzles 13 and providing a pressure to eject ink through the nozzles 13, and a flow channel to supply the ink from an ink tank 15 to the chamber. Chambers, ejecting units, and ink flow channels are well known to those of ordinary skill in the art, and thus the description thereof will not be given here.

A platen 60 faces the nozzle unit 11 and supports the rear surface of the paper P. The platen 60 is placed such that the nozzle unit 11 of the inkjet printhead 10 is separated from the fed paper P by a predetermined distance, for example, about 0.5 to about 2.5 mm. A discharging unit 30 to discharge the paper P is installed at an exit of the inkjet printhead 10.

The nozzle unit 11 must be maintained in an optimal condition to achieve high quality printing. To do this, maintenance operations such as wiping, capping, and spitting are performed. Wiping refers to rubbing the surface(s) of the nozzle unit 11 to remove solidified ink from the surface(s) of the nozzle unit 11 and foreign substances around each of the nozzles 13. Capping refers to covering the nozzle unit 11 to prevent drying of the nozzles 13 when printing is not performed for a predetermined period of time or longer.

Figure 3:
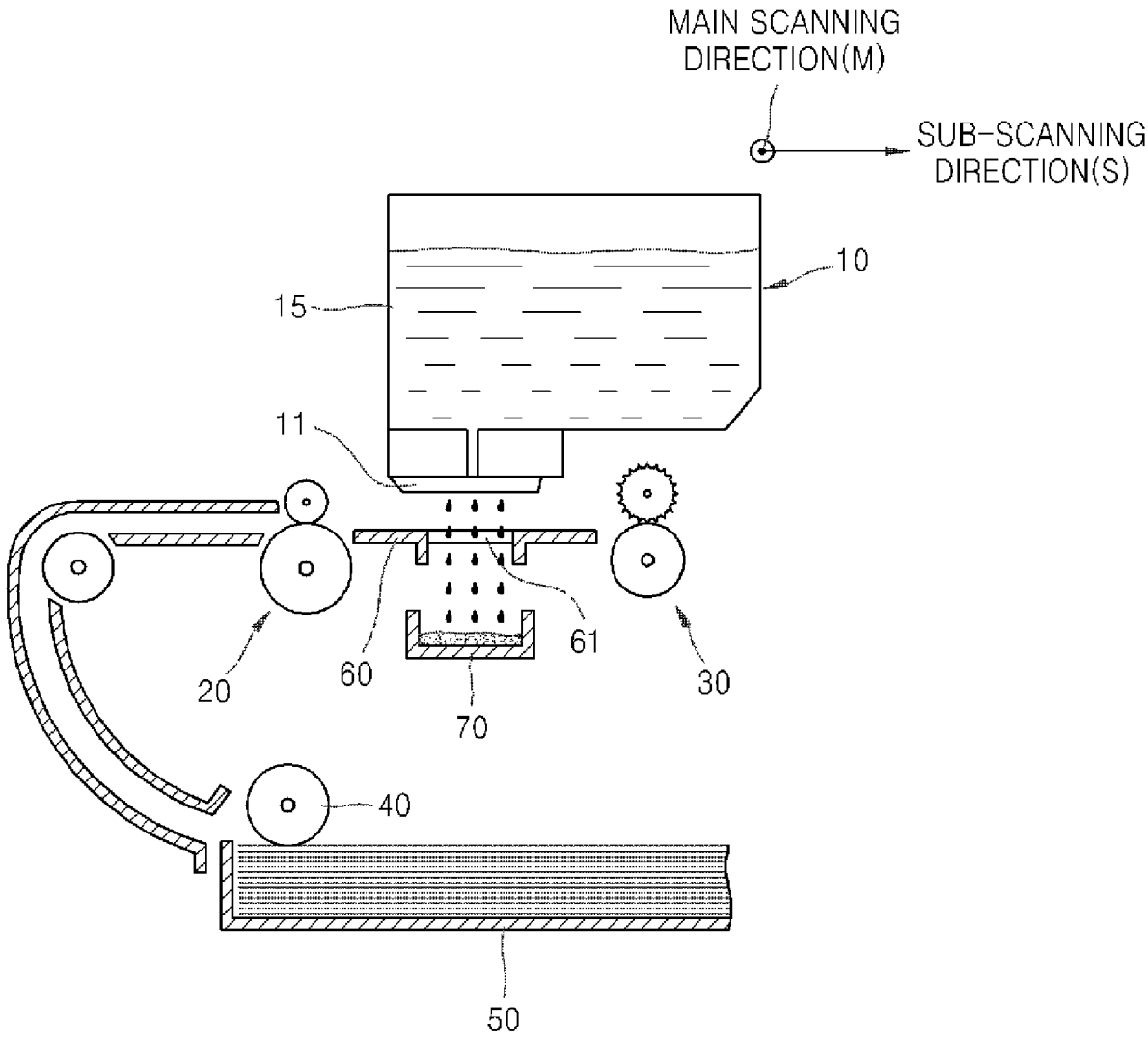
FIG. 3 illustrates a spitting operation according to an embodiment of the present general inventive concept.

The present general inventive concept relates to spitting of ink through the nozzles. Spitting is performed after a predetermined number of papers are printed on and before the next printing operation begins. The ink inside the nozzles 13 not used or used less frequently than in other nozzles 13 during printing loses moisture, and thus results in a high viscosity of that ink, causing bad ejecting of the ink through the nozzles 13. Spitting refers to charging the nozzles 13 with fresh ink by discarding a portion of the ink inside the nozzles 13, as illustrated in FIG. 3, before the next printing operation. To perform the spitting operation, the image forming apparatus includes an accommodating unit 70 to in which to accommodate the discarded ink. The platen 60 may have an opening 61 through which the ink can fall into the accommodating unit 70. Though not illustrated in the drawing, the platen 60 may be moved so that the spitted ink can fall into the accommodating unit 70. When borderless printing is considered, about 4960 nozzles 13 or more than 5000 nozzles 13 are needed to print on size A4 paper, which is 210 mm long in the main scanning direction M, with a resolution of 600 dpi (dot/inch) in the main scanning direction M. If spitting is equally performed for all of the 5000 nozzles 13, that is, if each of the 5000 nozzles discards ink an identical number of times, the amount of the discarded ink becomes large. Thus, reduction of the amount of ink discarded using spitting is a significant factor for an array-type inkjet image forming apparatus. In addition, ink ejection during the spitting operation may decline the life span of the nozzles 13.

The more frequently one of the nozzles 13 is used in printing, the shorter is the time in which ink is exposed to air, and accordingly, the possibility of the increase of viscosity of the ink, or the degree and amount of the increase of the viscosity of the ink, is small. Accordingly, spitting of the nozzles 13 that are frequently used during printing does not need to be performed as often as that of the nozzles 13 that are infrequently used during printing. Thus, in an embodiment of the present general inventive concept, a number of spitting dots of each of the nozzles 13 can be set in proportion to the number of resting dots of each of the nozzles 13 before spitting is performed in the printing process.

The number of spitting dots NSi of each the nozzles 13 is determined as $NSi \propto NEi/NT$, wherein NT is the total number of dots in the sub-scanning direction S of the printed image and NEi is the number of resting dots of each of the nozzles 13. Here, i is an index of the nozzles 13. When the standard number of spitting dots needed to recover the nozzles 13 un-used in the printing process to an optimal condition is NR, the number of spitting dots NSi of each of the nozzles is set equal to $NR \times (NEi/NT)$. The standard spitting dot number NR can vary according to a property of the ink and a condition of the nozzles, and can be set experimentally.

In such a configuration, spitting of the nozzles 13 which are frequently used during printing is performed with a small number of spitting dots, and spitting of the nozzles 13 which are infrequently used during printing is performed with a large number of spitting dots. Thus, the amount of ink used during spitting can be reduced in comparison with the spitting of all the nozzles 13 with the standard number of spitting dots NR.

The number of spitting dots of the nozzles 13 which are frequently used during printing is very small, and sometimes even zero. However, it is preferable to perform spitting with a minimum number of spitting dots Nmin for all of the nozzles 13, even though they are all used very often. According to an experiment, it is an exemplary embodiment to set the minimum number of spitting dots Nmin as at least five.

To secure the minimum number of spitting dots Nmin, two approaches can be considered. One approach is to set the number of spitting dots NSi to the minimum number of spitting dots Nmin when the number of spitting dots NSi calculated using the equation NSi=NR ×(NEi/NT) is smaller than the minimum number of spitting dots Nmin. The other approach is to set the number of spitting dots NSi to NR×(NEi/NT)+Nmin.

To perform spitting, the number NEi of resting dots of each of the nozzles 13 may be directly counted or obtained by counting the number of printing dots and substracting the number of printing dots from the total number of spitting dots.

Figure 4A:
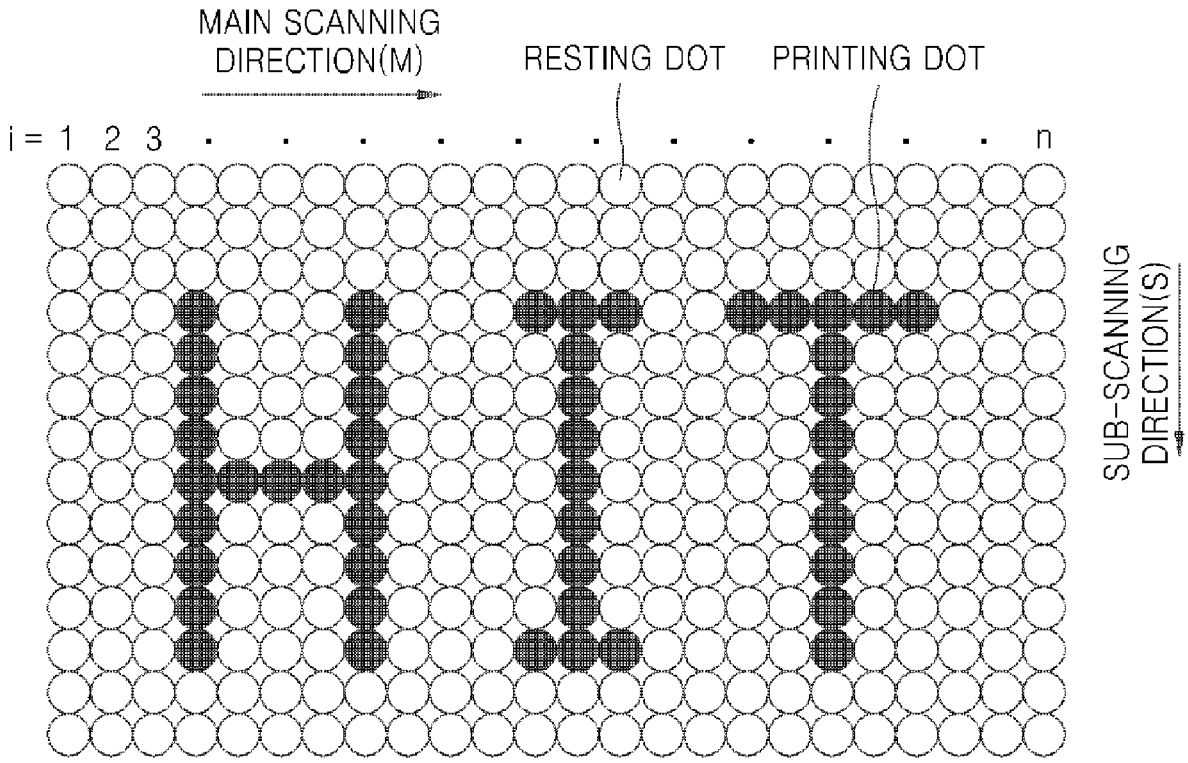
FIG. 4A illustrates an example of a mapped printing image.
Figure 4B:
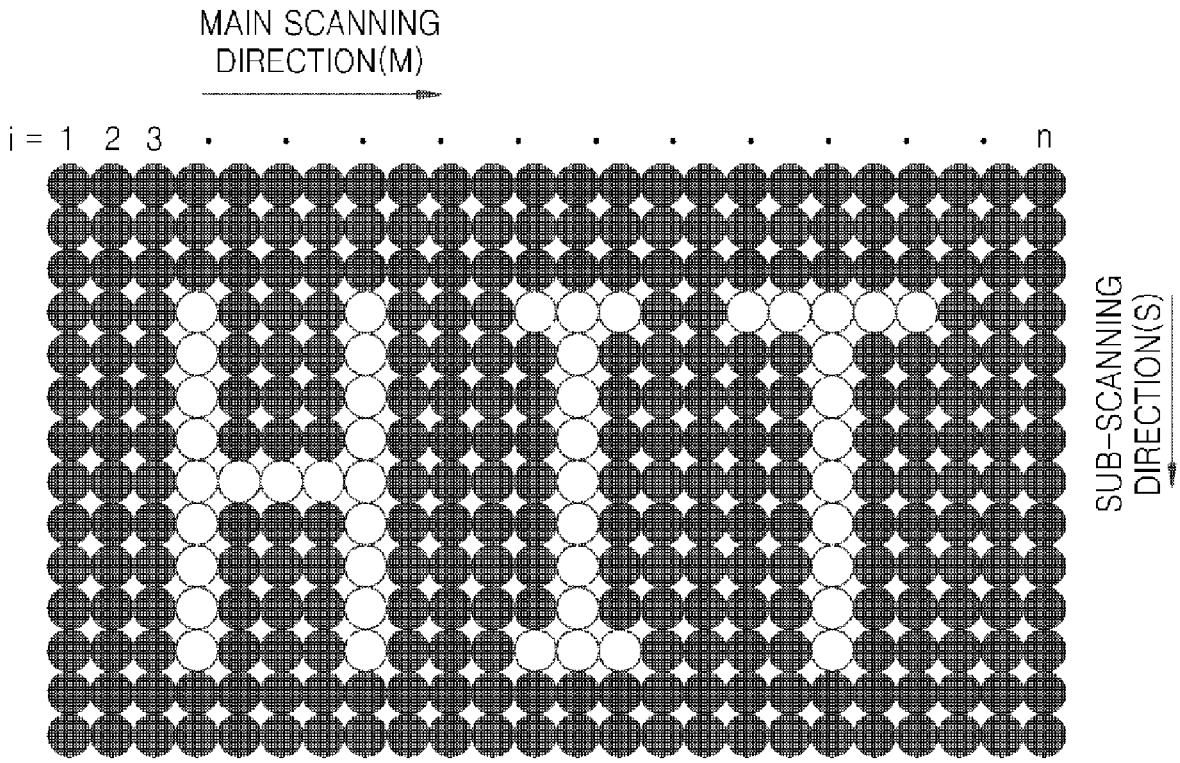
FIG. 4B illustrates an inverse image of a printing image.
Figure 4C:
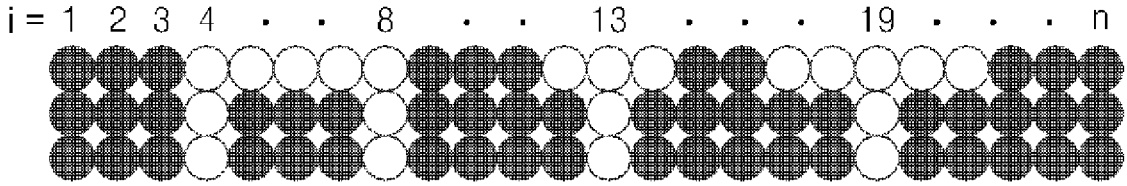
FIG. 4C illustrates a compressed spitting image of the inverse image of FIG. 4B.

Alternatively, a spitting method using a printing image may be considered. This method is described hereinafter with reference to FIGS. 4A through 4E, and FIG. 5. The mapped images of FIGS. 4A through 4E, and FIG. 5 are illustrated only to describe a spitting method according to another embodiment of the present general inventive concept, and accordingly FIGS. 4A through 4E, and FIG. 5 are not prepared by exact calculation. To print an image, a printing image received from a host computer (not illustrated) is mapped to the nozzles 13 (operation S10). Then, an inverse image of the mapped image is generated (operation S20). FIGS. 4A and 4B respectively illustrate a mapped printing image and an inverse image. Next, the generated inverse image is compressed in the sub-scanning direction S and thus a spitting image as illustrated in FIG. 4C is obtained (operation S40). The compression rate is a resultant value (NR/NT) obtained by dividing the standard number of the spitting dots NR by the total number of dots NT in the sub-scanning direction S of the printing image (operation S30). Further, the same compression rate is used for all of the nozzles 13. The number of spitting dots NSi of each of the nozzles 13 in the case of the spitting image obtained in the above described manner is equal to NR×(NEi/NT).

Referring to the spitting image of FIG. 4C, the numbers of the spitting dots NS4, NS8, NS13, and NS19 of nozzles 13 numbered as 4, 8, 13, and 19, respectively, are zero. There may exist nozzles 13 of which the numbers of spitting dots NSi is smaller than the minimum number of spitting dots Nmin. The spitting image is corrected to secure the minimum number of spitting dots Nmin with respect to each of the nozzles 13 (operation S50).

Figure 4D:
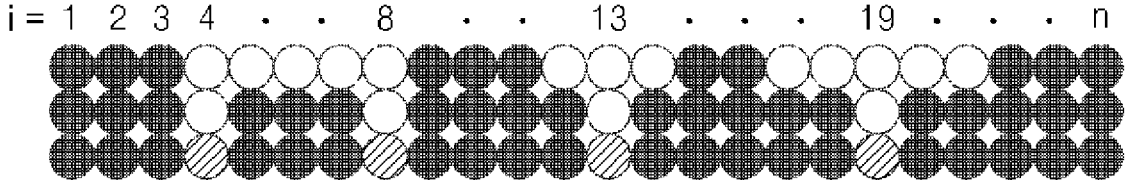
FIG. 4D illustrates an example of a corrected spitting image.

As illustrated in FIG. 4D, the spitting images may be corrected to secure the minimum numbers of spitting dots Nmin for the nozzles 13 such that the numbers of spitting dots NS4, NS8, NS13, and NS19 are equal to the minimum number of spitting dots Nmin. Though not illustrated exactly in FIG. 4D, when there are nozzles 13 of which the numbers of spitting dots NSi is smaller than the minimum number of spitting dots Nmin, only the spitting images corresponding to these nozzles 13 are corrected such that the number of spitting dots equals the minimum number of spitting dots Nmin.

Figure 4E:
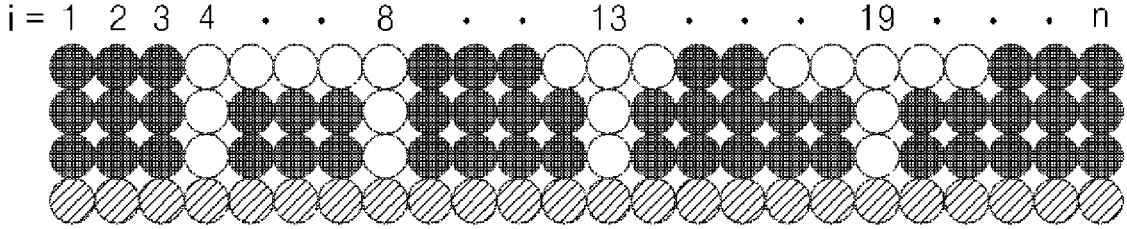
FIG. 4E illustrates another example of a corrected spitting image.

Furthermore, as illustrated in FIG. 4E, the spitting images can be corrected by adding the minimum number of spitting dots to the spitting images of FIG. 4C so that all the nozzles 13 further perform spitting as many times as the minimum number of the spitting dots Nmin.

After a spitting image is generated according to the process described above, an image is printed according to the mapped printing image (operation S60). When another image must be printed (operation S70) after the image is printed, the nozzles 13 perform spitting by ejecting ink according to the generated spitting images. Thus, all of the nozzles 13 can be in an optimal printing condition.

Figure 4F:
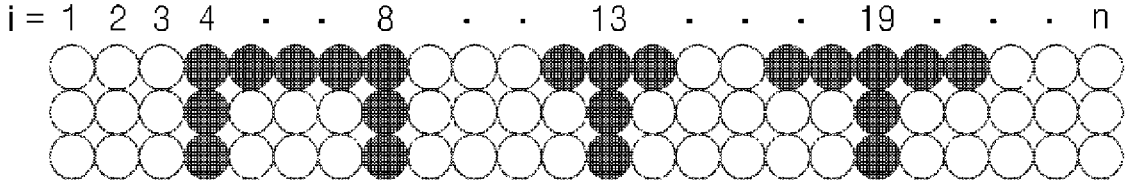
FIG. 4F illustrates a compressed printed image.
Figure 5:
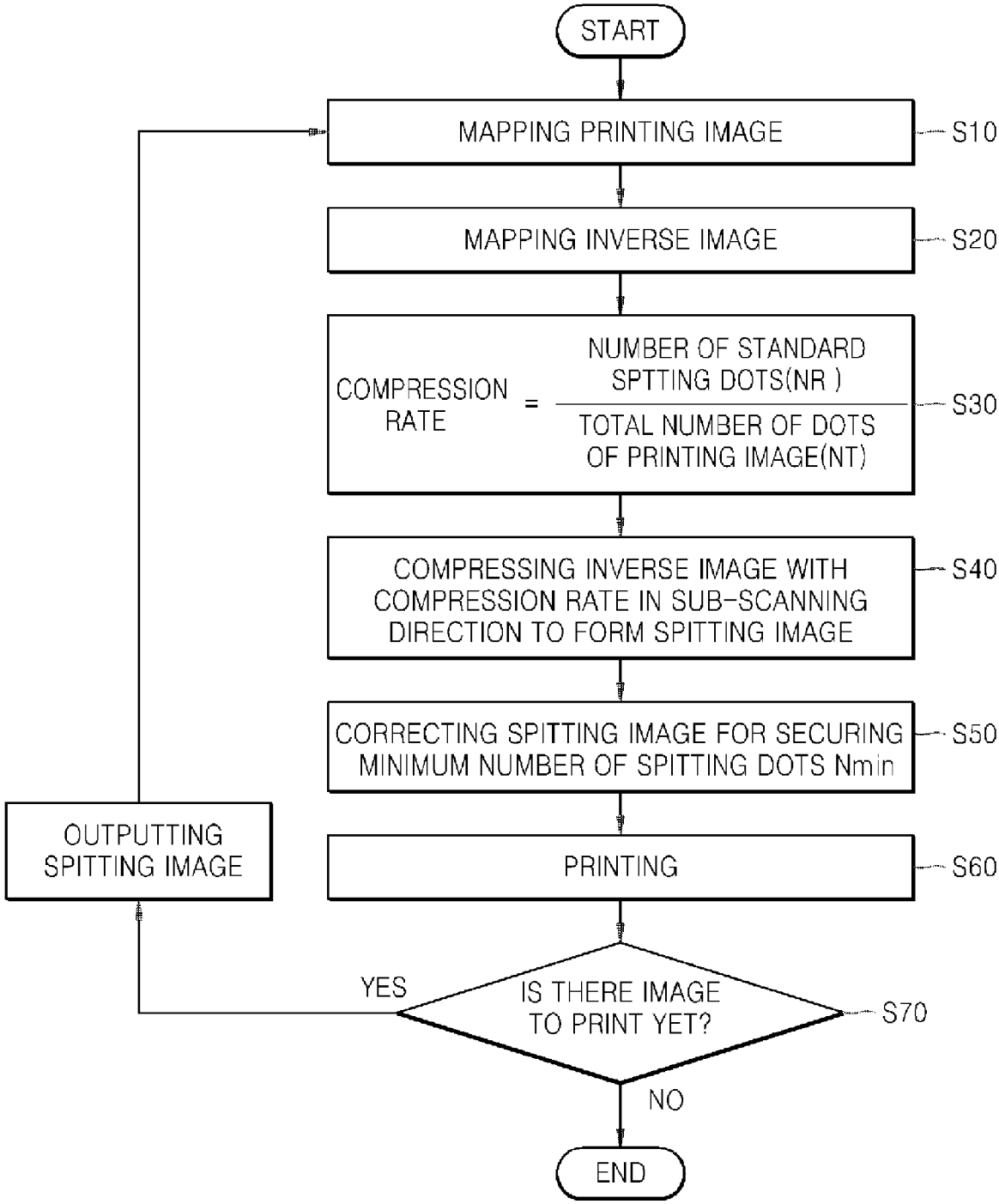
FIG. 5 is a flowchart illustrating a printing process in which spitting is performed according to an embodiment of the present invention.

In another embodiment of the spitting method using a printing image, a mapped printing image is duplicated with respect to each of the nozzles 13 and then compressed in the sub-scanning direction S to obtain a spitting image. The compression rate used is equal to (NR/NT), obtained by dividing the standard number of the standard spitting dots NR by the total number of the dots in the sub-scanning direction NT, and the same compression rate is applied for all of the nozzles 13. Thus, an image as illustrated in FIG. 4F can be obtained. If the image is reversed, the spitting image as illustrated in FIG. 4C can be obtained. A subsequent correction performed to secure the minimum number of spitting dots is as described above.

According to the spitting methods of the various embodiments of the present general inventive concept, effects such as, for example, the following can be obtained.

The amount of ink used in the spitting process is reduced, and thus an amount of ink contained in the ink tank and used for printing is increased.

Since an amount of ink spitted and discarded is small, an accommodating unit for the discarded ink can be small, thereby making it possible to reduce the size of the image forming apparatus.

Decrease of the life span of the nozzles due to ink ejection in the spitting process can be prevented.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A spitting method of an array-type inkjet image forming apparatus which prints one or more papers and then ejects ink several times to keep nozzles in an optimal condition for printing, wherein the number of spitting dots of the nozzles is in proportion to the number of resting dots in each of the nozzles during the printing process.

2. The method of claim 1, wherein the number of spitting dots NSi is equal to NR×(NEi/NT), where i is an index of the nozzles, NT is the total number of dots in the sub-scanning direction of a printing image, NEi is the number of resting dots of each of the nozzles, and NR is the number of standard spitting dots.

3. The method of claim 2, wherein the number of NSi is set as the minimum number of spitting dots when the number of spitting dots NSi calculated by the equation NSi=NR×(NEi/NT) is smaller than the minimum number of spitting dots.

4. The method of claim 3, wherein the minimum number of spitting dots is greater than five.

5. The method of claim 2, wherein the number of spitting dots NSi of each of the nozzles is equal to the number of spitting dots NSi calculated by the equation NSi=NR×(NEi/NT) plus the minimum number of spitting dots (Nmin).

6. The method of claim 5, wherein the minimum number of spitting dots is greater than five.

7. The method of claim 2, wherein the standard spitting dot number NR is determined according to a property of the ink and a condition of the nozzles.

8. A spitting method of an array-type inkjet image forming apparatus which prints one or more papers and then ejects ink several times to keep nozzles in an optimal condition for printing, the method comprising:

mapping an inverse image of a printing image with respect to the nozzles;

forming a spitting image by compressing the mapped inverse image in a sub-scanning direction; and ejecting ink through the nozzles according to the formed spitting image.

9. The method of claim 8, wherein a compression rate in the sub-scanning direction is the same for each of the nozzles.

10. The method of claim 9, wherein the compression rate in the sub-scanning direction is obtained by dividing a number of standard spitting dots by the total number of dots in the sub-scanning direction of a printing image.

11. The method of claim 10, further comprising correcting the spitting image such that the number of spitting dots of each of the nozzles is equal to or greater than the minimum number of spitting dots before the spitting.

12. The method of claim 11, wherein in the correcting of the spitting image, only spitting images corresponding to nozzles of which the number of spitting dots is smaller than the minimum number of spitting dots are corrected to have the minimum number of spitting dots.

13. The method of claim 11, wherein in the correcting of the spitting image, the minimum number of spitting dots is added to the spitting image of all the nozzles.

14. The method of claim 11, wherein the minimum number of spitting dots is equal to or greater than five.

15. A spitting method for an array-type inkjet image forming apparatus which prints one or more papers and then ejects ink several times to keep nozzles in an optimal condition for printing, comprising:

forming a spitting image by compressing a mapped printing image with respect to the nozzles in a sub-scanning direction and then reversing the mapped printing image; and ejecting ink through the nozzles according to the spitting image.

16. The method of claim 15, wherein a compression rate in the sub-scanning direction is the same for each of the nozzles.

17. The method of claim 16, wherein a compression rate in the sub-scanning direction is obtained by dividing a number of standard spitting dots by the total number of dots in the sub-scanning direction of a printing image.

18. The method of claim 17, further comprising correcting the spitting image such that the number of spitting dots of each of the nozzles is equal to or greater than the minimum number of spitting dots before the spitting.

19. The method of claim 18, wherein in the correcting of the spitting image, only spitting images corresponding to the nozzles of which the number of spitting dots is smaller than the minimum number of spitting dots are corrected to have the minimum number of spitting dots.

20. The method of claim 18, wherein in the correcting of the spitting image, the minimum number of spitting dots is added to the spitting image of all the nozzles.

21. The method of claim 18, wherein the minimum number of spitting dots is equal to or greater than five.

22. A spitting method of an array-type inkjet image forming apparatus which prints one or more papers and then ejects ink several times to keep nozzles in an optimal condition for printing, the method comprising:

calculating a number of spitting dots of the nozzles based on a number of resting dots in each of the nozzles during the printing process.

* * * * *